US009709058B2

(12) United States Patent
Kanayama et al.

(10) Patent No.: US 9,709,058 B2
(45) Date of Patent: Jul. 18, 2017

(54) COMPRESSOR

(75) Inventors: Takehiro Kanayama, Kusatsu (JP); Naoto Tomioka, Kusatsu (JP); Yuuichirou Watanabe, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 329 days.

(21) Appl. No.: 14/346,701

(22) PCT Filed: Aug. 29, 2012

(86) PCT No.: PCT/JP2012/071832
§ 371 (c)(1),
(2), (4) Date: Mar. 21, 2014

(87) PCT Pub. No.: WO2013/047063
PCT Pub. Date: Apr. 4, 2013

(65) Prior Publication Data

US 2014/0227116 A1 Aug. 14, 2014

(30) Foreign Application Priority Data

Sep. 26, 2011 (JP) ..... 2011-208781

(51) Int. Cl.
*F04C 18/04* (2006.01)
*F04C 29/02* (2006.01)
(Continued)

(52) U.S. Cl.
CPC ..... *F04C 29/023* (2013.01); *F01C 21/108* (2013.01); *F04C 18/04* (2013.01);
(Continued)

(58) Field of Classification Search
CPC ..... F16C 23/041; F16C 27/02; F16C 25/02; F16C 25/04; F16C 17/03; F16C 17/035;
(Continued)

(56) References Cited

U.S. PATENT DOCUMENTS

2004/0071582 A1* 4/2004 Park ..... B22F 5/10 419/48
2008/0144983 A1* 6/2008 Fedotov ..... F16C 23/04 384/275
2011/0067434 A1* 3/2011 Miura ..... F01C 21/02 62/498

FOREIGN PATENT DOCUMENTS

JP 55-69180 U 5/1980
JP 2004124834 A * 4/2004 ..... F04C 23/00

OTHER PUBLICATIONS

Machine Translation of Japanese Patent JP 2004124834 A to Miyougahara, Masashi et al.*
(Continued)

*Primary Examiner* — Peter J Bertheaud
*Assistant Examiner* — Dnyanesh Kasture
(74) *Attorney, Agent, or Firm* — Global IP Counselors, LLP

(57) ABSTRACT

A compressor includes a closed container, a compression element disposed in the closed container, and a motor disposed in the closed container to drive the compression element via a shaft. The compression element includes a first and second bearings supporting the shaft. At least one cylinder having at least one cylinder chamber is disposed between the first and second bearings, with at least one roller fitted to the shaft disposed in the at least one cylinder chamber. The first bearing is disposed closer to the motor than the second bearing. The first and second bearings have first and second annular grooves formed in first and second opposing surfaces opposed to end faces of the at least one roller. The first and second annular grooves are opened to the at least one cylinder chamber. A width of the second annular groove is larger than a width of the first annular groove.

15 Claims, 3 Drawing Sheets

(51) Int. Cl.

| | |
|---|---|
| ***F01C 21/10*** | (2006.01) |
| ***F04C 18/356*** | (2006.01) |
| ***F04C 18/063*** | (2006.01) |
| ***F04C 23/00*** | (2006.01) |

(52) U.S. Cl.
CPC ..... *F04C 18/063* (2013.01); *F04C 18/356* (2013.01); *F04C 23/008* (2013.01); *F04C 29/028* (2013.01); *F04C 2240/56* (2013.01)

(58) Field of Classification Search
CPC ..... F01C 21/108; F04C 29/023; F04C 18/04; F04C 18/063; F04C 23/008; F04C 29/028; F04C 2240/56
See application file for complete search history.

(56) References Cited

OTHER PUBLICATIONS

International Preliminary Report of corresponding PCT Application No. PCT/JP2012/071832.
International Search Report of corresponding PCT Application No. PCT/JP2012/071832.

* cited by examiner

COMPRESSOR

CROSS-REFERENCE TO RELATED APPLICATIONS

This U.S. National stage application claims priority under 35 U.S.C. §119(a) to Japanese Patent Application No. 2011-208781, filed in Japan on Sep. 26, 2011, the entire contents of which are hereby incorporated herein by reference.

TECHNICAL FIELD

The present invention relates to a compressor to be used in, for example, air conditioners, refrigerators and the like.

BACKGROUND ART

Conventionally, there has been provided a compressor which includes a closed container, a compression element to be placed in the closed container, and a motor placed in the closed container to drive the compression element via a shaft (see JP S55-69180U)

Conventionally, the compression element includes first and second bearings for supporting a shaft, a cylinder to be placed between the first bearing and the second bearing, and a roller placed in the cylinder and fitted to the shaft.

The first bearing is placed closer to the motor than the second bearing. The first, second bearings each have an annular groove on an opposing surface opposed to an end face of the roller. In this case, the annular groove of the first bearing and the annular groove of the second bearing are equal in width to each other.

During operation of the above-described compressor, there may occur, from time to time, deflection of the shaft due to a gas load within the cylinder or other reasons, so that the shaft is brought into contact with the first, second bearings. Even in such a case, by the formation of the annular grooves, the first, second bearings are elastically deformed so that the contact of the shaft with the bearings can be made to be not point contact but plane contact. Thus, bearing pressures involved are reduced so that seizures are prevented.

In this connection, in order that lubricating oil present on the inner peripheral side of the roller is kept from leaking to the outer peripheral side of the roller through between an end face of the roller and the opposing surfaces of the first, second bearings, there has been a necessity for reducing the widths of the annular grooves to ensure seal lengths between the end face of the roller and the opposing surfaces of the first, second bearings.

For the conventional compressor shown above, since the width of the annular groove of the first bearing and the width of the annular groove of the second bearing are equal to each other, there has been a necessity for lessening both the width of the annular groove of the first bearing and the width of the annular groove of the second bearing.

However, machining of an annular groove of such a small width is a difficulty, and forming the annular grooves in both the first bearing and second bearing would take a long manufacturing time, leading to an increased manufacturing cost as a problem. Further, setting a larger depth for annular grooves to increase the elastic deformation of the first, second bearings would make it even more difficult to machine the annular grooves because of their small widths.

Moreover, with use of a low-priced sintered article for the material of the first, second bearings, machining of the annular grooves in the sintered article is impossible to fulfill because of high hardness of the sintered article, making it inevitable to use a casting article as the material of the first, second bearings. For example, for machining of the annular grooves with a cutting tool, the quantity of machinable casting articles per cutting tool was 100 to 200 pieces, while the quantity of machinable sintered articles was 5 pieces.

Thus, with the conventional compressor, it has been impossible to satisfy both the prevention of lubricating oil from leakage through between the bearings and the roller end face and the facilitation of formation of the annular grooves in the bearings at the same time.

SUMMARY

Technical Problem

An object of the present invention is, therefore, to provide a compressor capable of satisfying both the prevention of lubricating oil from leakage through between the bearings and the roller end face and the facilitation of formation of the annular grooves in the bearings at the same time.

Solution to Problem

In order to solve the problem, a compressor according to the present invention comprises:

a closed container;

a compression element placed in the closed container; and a motor placed in the closed container to drive the compression element via a shaft, wherein the compression element includes:

a front bearing and a rear bearing for supporting the shaft;

at least one cylinder placed between the front bearing and the rear bearing and having a cylinder chamber; and a roller placed in the cylinder chamber of the cylinder and fitted to the shaft, and wherein the front bearing is placed closer to the motor than the rear bearing, the front bearing has, in its opposing surface opposed to an end face of the roller, an annular-shaped front-side annular groove opened to the cylinder chamber of the cylinder, the rear bearing has, in its opposing surface opposed to an end face of the roller, an annular-shaped rear-side annular groove opened to the cylinder chamber of the cylinder, and a width of the rear-side annular groove is larger than a width of the front-side annular groove.

According to the compressor of this invention, since the width of the rear-side annular groove is larger than the width of the front-side annular groove, the width of the front-side annular groove can be made small, making it possible to ensure enough seal length between the end face of the roller and the opposing surface of the front bearing, so that the sealing performance can be improved.

Meanwhile, since the width of the rear-side annular groove can be made large, machining of the rear-side annular groove becomes easier to achieve. Still, in cases where the depth of the rear-side annular groove is increased to increase the elastic deformation of the rear bearing, since the width of the rear-side annular groove is large, it is easily achievable to increase the depth of the rear-side annular groove. Also, since the width of the rear-side annular groove can be made large, it becomes possible to mold the rear bearing by low-cost sintering in the state that the rear-side annular groove is provided. Thus, the manufacturing time for the rear bearing can be shortened, so that the manufacturing cost for the rear bearing can be reduced.

Even though the width of the rear-side annular groove is made large, there is less influence for leakage of the lubricating oil because leakage of the lubricating oil less occurs through between the opposing surface of the rear bearing and the end face of the roller than through between the opposing surface of the front bearing and the end face of the roller.

Thus, it becomes possible to satisfy both the prevention of lubricating oil from leakage through between the front bearing as well as the rear bearing and the end face of the roller and the facilitation of formation of the rear-side annular groove in the rear bearing at the same time.

In a compressor of one embodiment, the shaft includes:

a front shaft supported by the front bearing; and a rear shaft supported by the rear bearing, and wherein a diameter of the rear shaft is smaller than a diameter of the front shaft.

According to the compressor of this embodiment, since the diameter of the rear shaft is smaller than the diameter of the front shaft, the rear-side annular groove can be enlarged toward the axial center side of the shaft. As a result of this, even if the rear-side annular groove is enlarged, a region of the rear-side annular groove opposed to the end face of the roller can be reduced, so that enough seal length between the end face of the roller and the opposing surface of the rear bearing can be ensured to even more extent.

Also, the small-diameter rear shaft incurs larger deflection during the operation, making it indispensable particularly to provide the front-side annular groove and the rear-side annular groove for prevention of seizures between the shaft and the front bearing as well as the rear bearing. In this invention, even though the front-side annular groove and the rear-side annular groove are provided, it is achievable to satisfy both the prevention of lubricating oil from leakage through between the front bearing as well as the rear bearing and the end face of the roller and the facilitation of formation of the rear-side annular groove in the rear bearing at the same time.

In a compressor of one embodiment, a depth of the rear-side annular groove is larger than a depth of the front-side annular groove.

According to the compressor of this embodiment, since the depth of the rear-side annular groove is larger than the depth of the front-side annular groove, the elastic deformation of the rear bearing can be made large, so that the bearing pressure between the shaft and the rear bearing can be reduced with even more reliability, making it possible to prevent seizures of the shaft and the rear bearing with further reliability. Moreover, since the width of the rear-side annular groove can be made large, a deep machining of the rear-side annular groove can be achieved with simplicity.

In a compressor of one embodiment, at least the rear bearing of the front bearing and the rear bearing is formed by sintering.

According to the compressor of this embodiment, at least the rear bearing is formed by sintering. Thus, the rear bearing can be manufactured with low-cost sintering, so that the manufacturing cost can be further reduced.

In a compressor of one embodiment, the compression element includes:

the front bearing;

the rear bearing;

a first above-defined cylinder, an intermediate member and a second above-defined cylinder placed between the front bearing and the rear bearing in order from the front bearing side;

a first above-defined roller placed in a first above-defined cylinder chamber of the first cylinder; and a second above-defined roller placed in a second above-defined cylinder chamber of the second cylinder.

According to the compressor of this embodiment, since the compression element includes the first cylinder and the second cylinder, this compressor is a so-called two-cylinder compressor. In this two-cylinder compressor, since deflection of the shaft is increased due to an elongated distance between the front bearing and the rear bearing, it becomes indispensable particularly to provide the front-side annular groove and the rear-side annular groove for prevention of seizures between the shaft and the front bearing as well as the rear bearing. In this invention, even though the front-side annular groove and the rear-side annular groove are provided, it is achievable to satisfy both the prevention of lubricating oil from leakage through between the front bearing as well as the rear bearing and the end face of the roller and the facilitation of formation of the rear-side annular groove in the rear bearing at the same time.

In a compressor of one embodiment, a refrigerant compressed by the compression element is carbon dioxide.

According to the compressor of this embodiment, since the refrigerant compressed by the compression element is carbon dioxide, the cylinder chamber of the compression element comes to high pressure. In such high-load operation, there occurs large deflection of the shaft due to a high-pressure gas load, making it indispensable particularly to provide the front-side annular groove and the rear-side annular groove for prevention of seizures between the shaft and the front bearing as well as the rear bearing. In this invention, even though the front-side annular groove and the rear-side annular groove are provided, it is achievable to satisfy both the prevention of lubricating oil from leakage through between the front bearing as well as the rear bearing and the end face of the roller and the facilitation of formation of the rear-side annular groove in the rear bearing at the same time.

Advantageous Effects of Invention

According to the compressor of the present invention, since the width of the rear-side annular groove is larger than the width of the front-side annular groove, it becomes possible to satisfy both the prevention of lubricating oil from leakage through between the front bearing as well as the rear bearing and the end face of the roller and the facilitation of formation of the rear-side annular groove in the rear bearing at the same time.

DESCRIPTION OF EMBODIMENTS

Hereinbelow, the present invention will be described in detail by way of embodiments thereof illustrated in the accompanying drawings.

First Embodiment

Figure 1:
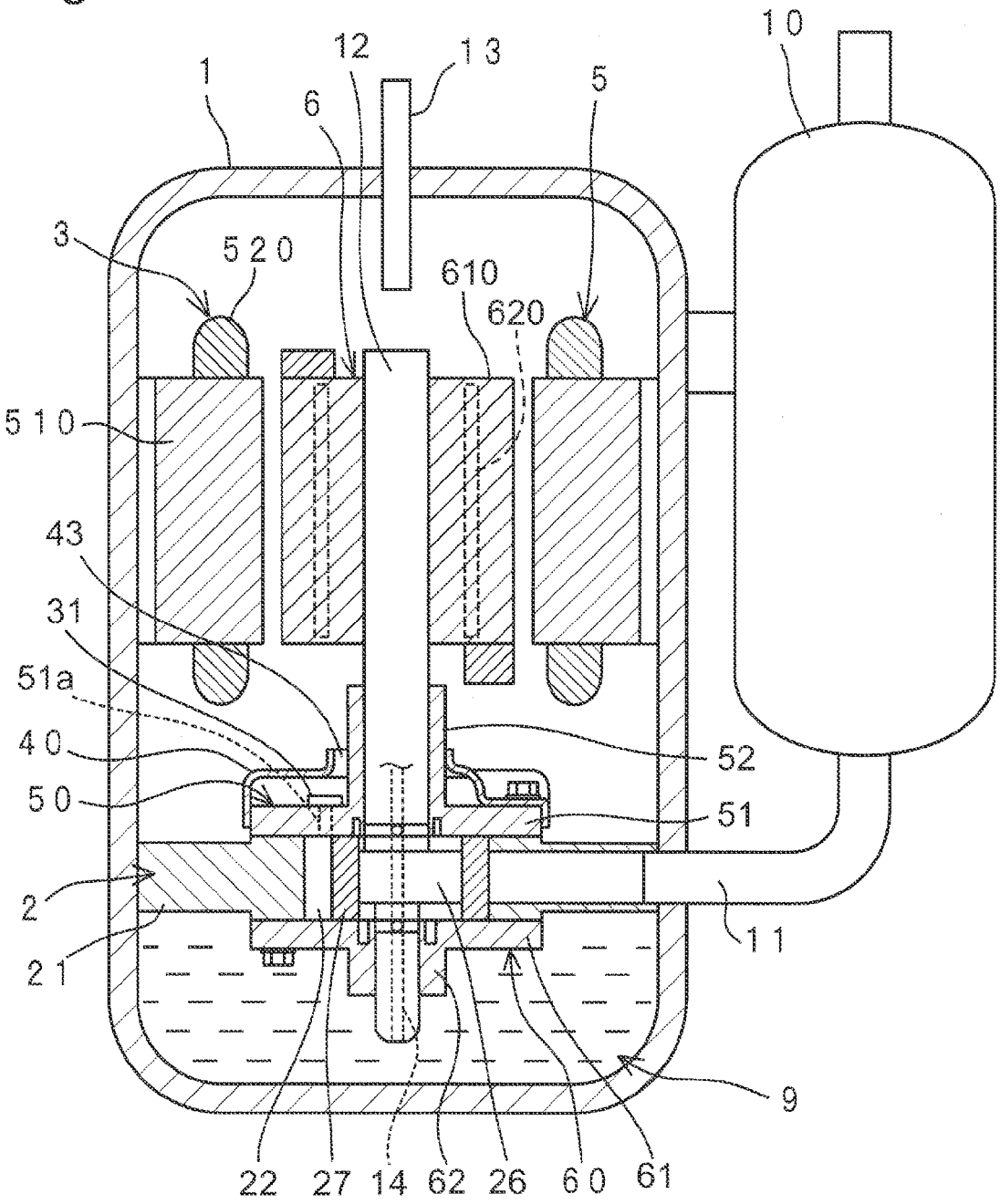
FIG. 1 is a longitudinal sectional view showing a first embodiment of the compressor according to the invention.

FIG. 1 is a longitudinal sectional view showing a first embodiment of the compressor according to the invention.

This compressor includes a closed container 1, a compression element 2 placed in the closed container 1, and a motor 3 placed in the closed container 1 to drive the compression element 2 via a shaft 12.

The compressor, which is a so-called vertically positioned high-pressure dome type rotary compressor, is placed in the closed container 1 with the compression element 2 below and the motor 3 above. By a rotor 6 of the motor 3, the compression element 2 is driven via the shaft 12.

The compression element 2 sucks in a refrigerant gas from an accumulator 10 through a suction pipe 11. This refrigerant gas is obtained by controlling a condenser, an expansion mechanism and an evaporator which are not shown and which make up an air conditioner as an example of a refrigeration system in combination with this compressor. Carbon dioxide is used as the refrigerant, but such refrigerants as HC, R410A or other HFCs and R22 or other HCFCs may also be used.

In this compressor, a high-temperature, high-pressure refrigerant gas compressed by the compression element 2 is discharged out from the compression element 2 to fill the inside of the closed container 1. Moreover, the refrigerant gas is passed through a gap between a stator 5 and the rotor 6 of the motor 3 so that the motor 3 is thereby cooled. Thereafter, the refrigerant gas is discharged outside through a discharge pipe 13 provided upward of the motor 3.

An oil reservoir 9 in which lubricating oil is stored is formed in lower portion of a high-pressure region within the closed container 1. This lubricating oil is passed from the oil reservoir 9 through an oil passage 14, which is provided in the shaft 12, so as to be moved to sliding portions such as bearings of the compression element 2 and the motor 3 or the like to lubricate these sliding portions. This lubricating oil is, for example, polyalkylene glycol oil (e.g., polyethylene glycol, polypropylene glycol), ether oil, ester oil or mineral oil.

The motor 3 has the rotor 6, and the stator 5 placed so as to surround outer periphery of the rotor 6.

The rotor 6 has a cylindrical-shaped rotor core 610, and a plurality of magnets 620 embedded in the rotor core 610. The rotor core 610 is formed of stacked electromagnetic steel sheets as an example. The shaft 12 is fitted at a central hole portion of the rotor core 610. The magnets 620 are planar-shaped permanent magnets. The plurality of magnets 620 are arrayed at equidistant central angles in the peripheral direction of the rotor core 610.

The stator 5 has a cylindrical-shaped stator core 510, and a coil 520 wound around the stator core 510. The stator core 510, which is formed of plural stacked steel sheets, is fitted into the closed container 1 by shrinkage fit or the like. The coil 520 is wound around each tooth portion of the stator core 510, where the coil 520 in this case is of the so-called concentrated winding.

The compression element 2 has a front bearing 50 and a rear bearing 60 for supporting the shaft 12, a cylinder 21 placed between the front bearing 50 and the rear bearing 60, and a roller 27 placed within the cylinder 21.

The cylinder 21 is fitted on the inner surface of the closed container 1. The cylinder 21 has a cylinder chamber 22. The front bearing 50 is placed closer to the motor 3 (upper) than the rear bearing 60. The front bearing 50 is fixed at an upper-side opening end of the cylinder 21, while the rear bearing 60 is fixed at a lower-side opening end of the cylinder 21.

The shaft 12 has an eccentric portion 26 placed in the cylinder chamber 22 of the compression element 2. The roller 27 is rotatably fitted to the eccentric portion 26. The roller 27 is placed revolvable (swingable) in the cylinder chamber 22, and the refrigerant gas in the cylinder chamber 22 is compressed by the revolving motion of the roller 27.

The front bearing 50 has a disc-shaped end plate portion 51, and a boss portion 52 provided in a center of the end plate portion 51 on one side counter to (above) the cylinder 21 side. The boss portion 52 holds the shaft 12.

In the end plate portion 51, a discharge hole 51*a* is provided so as to communicate with the cylinder chamber 22. A discharge valve 31 is attached to the end plate portion 51 so as to be positioned on one side of the end plate portion 51 counter to the cylinder 21 side. The discharge valve 31 is, for example, a reed valve, which opens and closes the discharge hole 51*a*.

A cup-type muffler cover 40 is attached to the end plate portion 51 on its one side counter to the cylinder 21 side so as to cover the discharge valve 31. The boss portion 52 extends through the muffler cover 40.

Inside of the muffler cover 40 communicates with the cylinder chamber 22 via the discharge hole 51*a*. The muffler cover 40 has a hole portion 43 which allows inside and outside of the muffler cover 40 to be communicated with each other.

The rear bearing 60 has a disc-shaped end plate portion 61, and a boss portion 62 provided in a center of the end plate portion 61 on one side counter to (below) the cylinder 21 side. The boss portion 62 holds the shaft 12. An axial length of the boss portion 62 of the rear bearing 60 is shorter than an axial length of the boss portion 52 of the front bearing 50.

Next, compression action by the compression element 2 is explained below.

First, as the eccentric portion 26 of the shaft 12 is eccentrically rotated, the roller 27 fitted to the eccentric portion 26 is revolved with the outer circumferential surface of the roller 27 kept in contact with the inner circumferential surface of the cylinder chamber 22.

Then, the refrigerant gas of low pressure is sucked into the cylinder chamber 22 through the suction pipe 11. After compressed to high pressure in the cylinder chamber 22, the refrigerant gas of high pressure is discharged from the discharge hole 51*a* of the front bearing 50.

Thereafter, the refrigerant gas discharged from the discharge hole 51*a* is discharged to the outside of the muffler cover 40 via the inside of the muffler cover 40.

Figure 2:
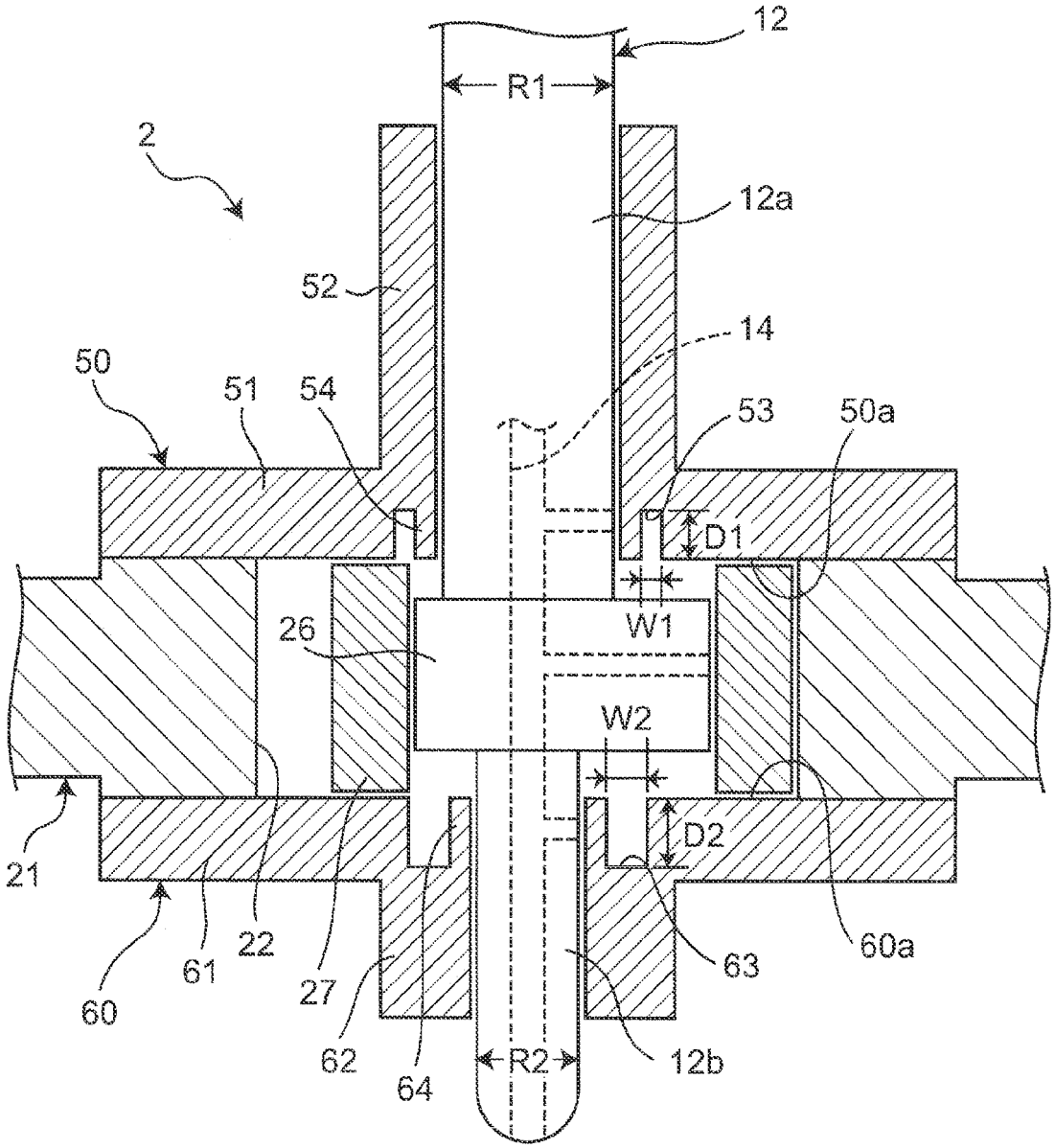
FIG. 2 is an enlarged view of the compression element.

As shown in FIG. 2, the end plate portion 51 of the front bearing 50 has a front-side annular groove 53 in an opposing surface 50*a* opposed to an end face of the roller 27. The front-side annular groove 53, which is formed into a circular annular shape centered on the axial center of the shaft 12, is opened to the cylinder chamber 22. In the end plate portion 51 of the front bearing 50, a circular annular-shaped front-side elastic portion 54 is formed radially inside the front-side annular groove 53.

The end plate portion 61 of the rear bearing 60 has a rear-side annular groove 63 in an opposing surface 60*a* opposed to an end face of the roller 27. The rear-side annular groove 63, which is formed into a circular annular shape centered on the axial center of the shaft 12, is opened to the cylinder chamber 22. In the end plate portion 61 of the rear bearing 60, a circular annular-shaped rear-side elastic portion 64 is formed radially inside the rear-side annular groove 63.

During operation of the above-described compressor, there occurs deflection of the shaft 12 due to a gas load within the cylinder chamber 22 or other reasons, so that the shaft 12 is brought into contact with the front bearing 50 and the rear bearing 60. By the formation of the front-side annular groove 53 in the front bearing 50, the front-side elastic portion 54 of the front bearing 50 is elastically deformed so that the contact of the shaft 12 with the front bearing 50 can be made to be not point contact but plane contact. Thus, a bearing pressure of the shaft 12 against the front bearing 50 is reduced so that seizures of the shaft 12 and the front bearing 50 are prevented. Similarly, by the formation of the rear-side annular groove 63 in the rear bearing 60, the rear-side elastic portion 64 of the rear bearing 60 is elastically deformed so that seizures of the shaft 12 and the rear bearing 60 are prevented.

A width W1 of the front-side annular groove 53 is constant along the depthwise direction of the front-side annular groove 53. That is, the width of the front-side elastic portion 54 is constant along the depthwise direction of the front-side annular groove 53.

A width W2 of the rear-side annular groove 63 is constant along the depthwise direction of the rear-side annular groove 63. That is, the width of the rear-side elastic portion 64 is constant along the depthwise direction of the rear-side annular groove 63.

The width W2 of the rear-side annular groove 63 is larger than the width W1 of the front-side annular groove 53. For example, the width W1 of the front-side annular groove 53 is 1 mm and the width W2 of the rear-side annular groove 63 is 2.5 mm.

A depth D2 of the rear-side annular groove 63 is deeper than a depth D1 of the front-side annular groove 53. For example, the depth D1 of the front-side annular groove 53 is 3 mm to 7 mm and the depth D2 of the rear-side annular groove 63 is 4 mm to 10 mm.

The shaft 12 has a front shaft 12*a* supported by the front bearing 50, and a rear shaft 12*b* supported by the rear bearing 60. A diameter R2 of the rear shaft 12*b* is smaller than a diameter R1 of the front shaft 12*a*. In other words, the inner diameter of the boss portion 62 of the rear bearing 60 is smaller than the inner diameter of the boss portion 52 of the front bearing 50.

The oil passage 14 provided in the shaft 12 is opened to the inner surface of the front-side elastic portion 54 of the front bearing 50, the inner surface of the roller 27 and the inner surface of the rear-side elastic portion 64 of the rear bearing 60, so that lubricating oil drawn up from the oil reservoir 9 is supplied to those inner surfaces. The oil passage 14 is formed by, for example, a spiral groove, and the spiral groove is turned by rotation of the shaft 12 to draw the lubricating oil up.

According to the compressor constructed as described above, the width W2 of the rear-side annular groove 63 is larger than the width W1 of the front-side annular groove 53. Therefore, the width W1 of the front-side annular groove 53 can be made small, making it possible to ensure enough seal length between the end face of the roller 27 and the opposing surface 50*a* of the front bearing 50, so that the sealing performance can be improved. That is, it becomes more unlikely that the lubricating oil supplied through the oil passage 14 to the inner surface side of the roller 27 leaks toward the outer periphery side of the roller 27 from between the end face of the roller 27 and the opposing surface 50*a* of the front bearing 50.

Meanwhile, since the width W2 of the rear-side annular groove 63 can be made large, the machining of the rear-side annular groove 63 becomes easier to achieve. Also, since the width W2 of the rear-side annular groove 63 can be made large, it becomes possible to mold the rear bearing 60 by low-cost sintering in the state that the rear-side annular groove 63 is provided. Thus, the manufacturing time for the rear bearing 60 can be shortened, so that the manufacturing cost for the rear bearing 60 can be reduced.

Even though the width W2 of the rear-side annular groove 63 is made large, there is less influence for leakage of the lubricating oil because leakage of the lubricating oil less occurs through between the opposing surface 60*a* of the rear bearing 60 and the end face of the roller 27 than through between the opposing surface 50*a* of the front bearing 50 and the end face of the roller 27.

Thus, it becomes possible to satisfy both the prevention of lubricating oil from leakage through between the front bearing 50 as well as the rear bearing 60 and the end face of the roller 27 and the facilitation of formation of the rear-side annular groove 63 in the rear bearing 60 at the same time.

That is, the present inventor, becoming aware of the following three points, has found that "leakage of the lubricating oil at the end face of the roller 27, generally, tends to occur more in quantity on the front bearing 50 side than on the rear bearing 60 side." Then, as a consequence, there has been derived an idea that "even though the width W2 of the rear-side annular groove 63 is made larger than the width W1 of the front-side annular groove 53, there is less influence for leakage of the lubricating oil from the rear bearing 60 side."

In the first point, high-pressure lubricating oil to be supplied is present on the inner peripheral side of the roller 27. This lubricating oil contains foaming gas, and this gas tends to be stored on the front bearing 50 side by the gravity. As a result of this, the gas is stored between the opposing surface 50*a* of the front bearing 50 and the end face of the roller 27, so that the sealing performance between the opposing surface 50*a* of the front bearing 50 and the end face of the roller 27 is inferior to the sealing performance between the opposing surface 60*a* of the rear bearing 60 and the end face of the roller 27.

In the second point, the roller 27 tends to lean on the rear bearing 60 side by the gravity, so that a gap between the opposing surface 50*a* of the front bearing 50 and the end face of the roller 27 becomes larger than a gap between the opposing surface 60*a* of the rear bearing 60 and the end face of the roller 27.

In the third point, the lubricating oil supplied to the inner peripheral side of the roller 27 is likely to be stored in the rear-side annular groove 63 more than in the front-side annular groove 53 by the gravity. As a result of this, the sealing performance between the opposing surface 50*a* of the front bearing 50 and the end face of the roller 27 is inferior to the sealing performance between the opposing surface 60*a* of the rear bearing 60 and the end face of the roller 27.

According to the compressor constructed as described above, since the diameter R2 of the rear shaft 12*b* is smaller than the diameter R1 of the front shaft 12*a*, the rear-side annular groove 63 can be enlarged toward the axial center side of the shaft 12. As a result of this, even if the rear-side annular groove 63 is enlarged, a region of the rear-side annular groove 63 opposed to the end face of the roller 27 can be reduced, so that enough seal length between the end face of the roller 27 and the opposing surface 60*a* of the rear bearing 60 can be ensured to even more extent.

Also, the small-diameter rear shaft 12*b* incurs larger deflection during the operation, making it indispensable particularly to provide the front-side annular groove 53 and the rear-side annular groove 63 for prevention of seizures between the shaft 12 and the front bearing 50 as well as the rear bearing 60. In this invention, even though the front-side annular groove 53 and the rear-side annular groove 63 are provided, it is achievable to satisfy both the prevention of lubricating oil from leakage through between the front bearing 50 as well as the rear bearing 60 and the end face of the roller 27 and the facilitation of formation of the rear-side annular groove 63 in the rear bearing 60 at the same time.

According to the compressor constructed as described above, since the depth D2 of the rear-side annular groove 63 is larger than the depth D1 of the front-side annular groove 53, the elastic deformation of the rear-side elastic portion 64 of the rear bearing 60 can be made large, so that the bearing pressure between the shaft 12 and the rear bearing 60 can be reduced with even more reliability, making it possible to prevent seizures of the shaft 12 and the rear bearing 60 with further reliability. Moreover, since the width W2 of the rear-side annular groove 63 can be made large, a deep machining of the rear-side annular groove 63 can be achieved with simplicity.

According to the compressor constructed as described above, since the refrigerant compressed by the compression element 2 is carbon dioxide, the cylinder chamber 22 of the compression element 2 comes to high pressure. In such high-load operation, there occurs large deflection of the shaft 12 due to a high-pressure gas load, making it indispensable particularly to provide the front-side annular groove 53 and the rear-side annular groove 63 for prevention of seizures between the shaft 12 and the front bearing 50 as well as the rear bearing 60. In this invention, even though the front-side annular groove 53 and the rear-side annular groove 63 are provided, it is achievable to satisfy both the prevention of lubricating oil from leakage through between the front bearing 50 as well as the rear bearing 60 and the end face of the roller 27 and the facilitation of formation of the rear-side annular groove 63 in the rear bearing 60 at the same time.

At least the rear bearing 60 of the front bearing 50 and the rear bearing 60 is formed by sintering. Thus, at least the rear bearing 60 can be manufactured with low-cost sintering, so that the manufacturing cost can be further reduced.

Second Embodiment

Figure 3:
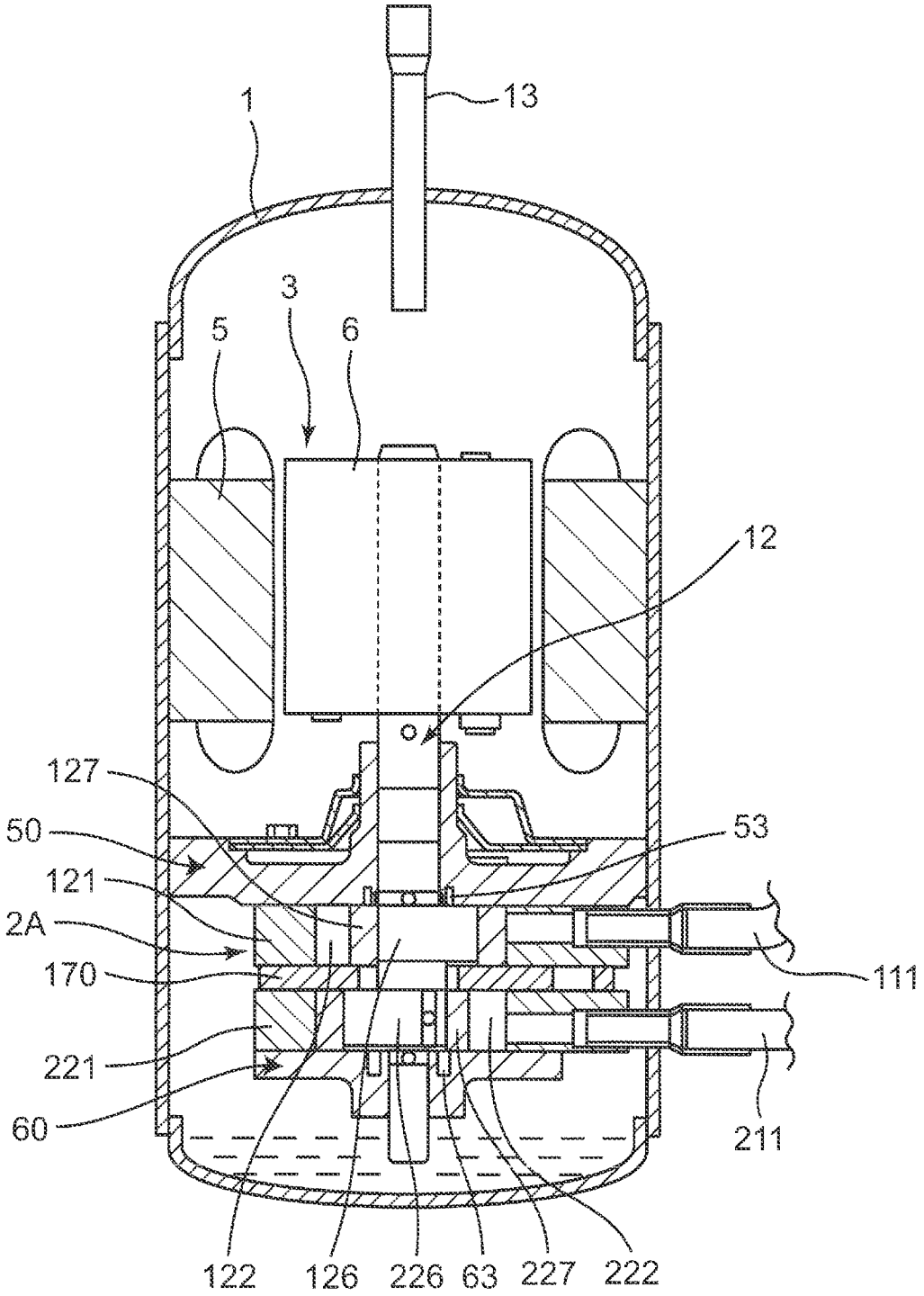
FIG. 3 is a longitudinal sectional view showing a second embodiment of the compressor according to the invention.

FIG. 3 shows a second embodiment of the compressor according to the invention. This second embodiment differs from the first embodiment in terms of the cylinder quantity. In this second embodiment, like reference signs designate like constituent members in conjunction with the first embodiment and so their description is omitted.

As shown in FIG. 3, this compressor is a two-cylinder compressor, in which a compression element 2A includes the front bearing 50, the rear bearing 60, a first cylinder 121, an intermediate member 170 and a second cylinder 221 placed between the front bearing 50 and the rear bearing 60, a first roller 127, and a second roller 227.

The first cylinder 121, the intermediate member 170 and the second cylinder 221 are placed in order along a shaft 12 from the front bearing 50 side toward the rear bearing 60 side.

The first cylinder 121 is sandwiched between the front bearing 50 and the intermediate member 170. A first cylinder chamber 122 of the first cylinder 121 is communicated with a first pipe 111 connected to an unshown accumulator.

The first roller 127 is fitted to a first eccentric portion 126 of the shaft 12 placed in the first cylinder chamber 122. The first roller 127, which is placed revolvable in the first cylinder chamber 122, is eccentrically rotated within the first cylinder 121 to perform compression action. The refrigerant gas compressed in the first cylinder chamber 122 is discharged via a muffler to outside of the first cylinder chamber 122.

The second cylinder 221 is sandwiched between the intermediate member 170 and the rear bearing 60. A second cylinder chamber 222 of the second cylinder 221 is communicated with a second pipe 211 connected to an unshown accumulator.

The second roller 227 is fitted to a second eccentric portion 226 of the shaft 12 placed in the second cylinder chamber 222. The second roller 227, which is placed revolvable in the second cylinder chamber 222, is eccentrically rotated within the second cylinder 221 to perform compression action. The refrigerant gas compressed in the second cylinder chamber 222 is discharged via a muffler to outside of the second cylinder chamber 222.

As in the first embodiment (FIG. 2), the front bearing 50 has, in its opposing surface 50*a* opposed to an end face of the first roller 127, a front-side annular groove 53 opened to the first cylinder chamber 122 of the first cylinder 121. The rear bearing 60 has, in its opposing surface 60*a* opposed to an end face of the second roller 227, a rear-side annular groove 63 opened to the second cylinder chamber 222 of the second cylinder 221. A width W2 of the rear-side annular groove 63 is larger than a width W1 of the front-side annular groove 53.

Therefore, in this two-cylinder compressor, since deflection of the shaft 12 is increased due to an elongated distance between the front bearing 50 and the rear bearing 60, it becomes indispensable particularly to provide the front-side annular groove 53 and the rear-side annular groove 63 for prevention of seizures between the shaft 12 and the front bearing 50 as well as the rear bearing 60. In this invention, even though the front-side annular groove 53 and the rear-side annular groove 63 are provided, it is achievable to satisfy both the prevention of lubricating oil from leakage through between the front bearing 50 as well as the rear bearing 60 and the end face of the roller 27 and the facilitation of formation of the rear-side annular groove 63 in the rear bearing 60 at the same time.

It is noted that the present invention is not limited to the above-described embodiments. It is also possible, for example, to combine respective features of the individual first and second embodiments in various ways.

The diameter of the rear shaft and the diameter of the front shaft may be equal to each other. Also, the depth of the rear-side annular groove and the depth of the front-side annular groove may be equal to each other.

What is claimed is:

1. A compressor comprising:

a closed container;

a compression element disposed in the closed container; and a motor disposed in the closed container, the motor being configured and arranged to drive the compression element via a shaft, the compression element including a first bearing configured and arranged to support the shaft, a second bearing configured and arranged to support the shaft, at least one cylinder disposed between the first bearing and the second bearing, the at least one cylinder having at least one cylinder chamber, and at least one roller disposed in the at least one cylinder chamber and fitted to the shaft, the first bearing being disposed closer to the motor than the second bearing, the first bearing having a first annular groove formed in a first opposing surface thereof that is opposed to a first end face of the at least one roller, the first annular groove being opened to the at least one cylinder chamber, the second bearing having a second annular groove formed in a second opposing surface thereof that is opposed to a second end face of the at least one roller, the second annular groove being opened to the at least one cylinder chamber, a width of the second annular groove being larger than a width of the first annular groove, a second groove inner circumferential surface of the second annular groove facing radially outwardly and extending from the second opposing surface to a trough of the second annular groove, the first bearing having a portion disposed radially inwardly of the first annular groove and having a radially inwardly facing first bearing surface, and the whole second groove inner circumferential surface being disposed radially inwardly of the radially inwardly facing surface of the portion of the first bearing that is disposed radially inwardly of the first annular groove.

2. The compressor as claimed in claim 1, wherein the shaft includes a first shaft portion supported by the first hearing, and a second shaft portion supported by the second bearing, with a diameter of the second shaft portion being smaller than a diameter of the first shaft portion.

3. The compressor as claimed in claim 1, wherein a depth of the second annular groove is larger than a depth of the first annular groove.

4. The compressor as claimed in claim 1, wherein at least the second bearing is formed of a sintered material.

5. The compressor as claimed in claim 1, wherein the at least one cylinder includes a first cylinder having a first cylinder chamber and a second cylinder having a second cylinder chamber, the at least one roller includes a first roller disposed in the first cylinder chamber and a second roller disposed in the second cylinder chamber, the first cylinder is disposed adjacent the first hearing and the second cylinder is disposed adjacent the second bearing such that the first and second opposing surfaces are opposed to the first and second end faces of the first and second rollers, respectively, and the first and second annular grooves are opened to the first and second cylinder chambers, respectively, and the compression element includes an intermediate member disposed between the first and second cylinders.

6. The compressor as claimed in claim 1, wherein a refrigerant compressed by the compression element is carbon dioxide.

7. The compressor as claimed in claim 1, wherein a second groove outer circumferential surface of the second annular groove is disposed radially inwardly of a first groove outer circumferential surface of the first annular groove.

8. The compressor as claimed in claim 2, wherein a depth of the second annular groove is larger than a depth of the first annular groove.

9. The compressor as claimed in claim 8, wherein at least the second bearing is formed of a sintered material.

10. The compressor as claimed in claim 9, wherein the at least one cylinder includes a first cylinder having a first cylinder chamber and a second cylinder having a second cylinder chamber, the at least one roller includes a first roller disposed in the first cylinder chamber and a second roller disposed in the second cylinder chamber, the first cylinder is disposed adjacent the first bearing and the second cylinder is disposed adjacent the second bearing, such that the first and second opposing surfaces are opposed to the first and second end faces of the first and second rollers, respectively, and the first and second annular grooves are opened to the first and second cylinder chambers, respectively, and the compression element includes an intermediate member disposed between the first and second cylinders.

11. The compressor as claimed in claim 2, wherein at least the second bearing is formed of a sintered material.

12. The compressor as claimed in claim 2, wherein the at least one cylinder includes a first cylinder having a first cylinder chamber and a second cylinder haying a second cylinder chamber, the at least one roller includes a first roller disposed in the first cylinder chamber and a second roller disposed in the second cylinder chamber, the first cylinder is disposed adjacent the first bearing and the second cylinder is disposed adjacent the second bearing such that the first and second opposing surfaces are opposed to the first and second end faces of the first and second rollers, respectively, and the first and second annular grooves are opened to the first and second cylinder chambers, respectively, and the compression element includes an intermediate member disposed between the first and second cylinders.

13. The compressor as claimed in claim 3, wherein at least the second bearing is formed of a sintered material.

14. The compressor as claimed in claim 3, wherein the at least one cylinder includes a first cylinder having a first cylinder chamber and a second cylinder having a second cylinder chamber, the at least one roller includes a first roller disposed in the first cylinder chamber and a second roller disposed in the second cylinder chamber, the first cylinder is disposed adjacent the first bearing and the second cylinder is disposed adjacent the second bearing such that the first and second opposing surfaces are opposed to the first and second end faces of the first and second rollers, respectively, and the first and second annular grooves are opened to the first and second cylinder chambers, respectively, and the compression element includes an intermediate member disposed between the first and second cylinders.

15. The compressor as claimed in claim 4, wherein the at least one cylinder includes a first cylinder having a first cylinder chamber and a second cylinder having a second cylinder chamber, the at least one roller includes a first roller disposed in the first cylinder chamber and a second roller disposed in the second cylinder chamber, the first cylinder is disposed adjacent the first bearing and the second cylinder is disposed adjacent the second bearing such that the first and second opposing surfaces are opposed to the first and second end faces of the first and second rollers, respectively, and the first and second annular grooves are opened to the first and second cylinder chambers, respectively, and the compression element includes an intermediate member disposed between the first and second cylinders.

* * * * *